US008237523B2

(12) United States Patent
Helmreich

(10) Patent No.: US 8,237,523 B2
(45) Date of Patent: Aug. 7, 2012

(54) RELAY WITH SNAP ACTION SPRING

(75) Inventor: Johannes Helmreich, Zwettl (AT)

(73) Assignee: Tyco Electronics Austria GmbH, Vienna (AT)

( * ) Notice: Subject to any disclaimer, the term of this patent is extended or adjusted under 35 U.S.C. 154(b) by 106 days.

(21) Appl. No.: 12/618,289

(22) Filed: Nov. 13, 2009

(65) Prior Publication Data

US 2010/0123533 A1 May 20, 2010

(30) Foreign Application Priority Data

Nov. 15, 2008 (DE) ..... 10 2008 057 555

(51) Int. Cl.
*H01H 51/22* (2006.01)
*H01H 5/00* (2006.01)

(52) U.S. Cl. ..... 335/83; 335/78; 335/79; 335/86; 335/89; 335/97; 200/400; 200/402; 200/405; 200/407; 200/449

(58) Field of Classification Search ..... 335/78–98, 335/185, 188, 59, 64; 200/400–402, 405–408, 200/447, 449
See application file for complete search history.

(56) References Cited

U.S. PATENT DOCUMENTS

| | | | | |
|---|---|---|---|---|
| 2,700,079 | A * | 1/1955 | Haydon | 200/460 |
| 3,120,590 | A * | 2/1964 | Dahlin | 200/460 |
| 3,348,176 | A * | 10/1967 | Gullett | 335/181 |
| 4,794,216 | A | 12/1988 | Seeger | |
| 5,270,506 | A * | 12/1993 | Masoner | 200/468 |
| 5,909,162 | A * | 6/1999 | Ikeda et al. | 335/78 |
| 6,943,653 | B2 | 9/2005 | Hanke et al. | |
| 7,477,119 | B2 * | 1/2009 | Wu | 335/83 |
| 7,479,609 | B1 * | 1/2009 | Kim et al. | 200/83 P |

FOREIGN PATENT DOCUMENTS

| | | | |
|---|---|---|---|
| DE | 1166893 | B | 4/1964 |
| DE | 1640571 | A | 8/1970 |
| DE | 7015225 | U | 9/1973 |
| DE | 3147563 | A1 | 10/1982 |
| DE | 3541965 | A1 | 6/1987 |
| DE | 3823852 | A1 | 2/1989 |
| DE | 8437085 | U1 | 10/1989 |
| DE | 102006016657 | A1 | 10/2007 |

OTHER PUBLICATIONS

German Patent Office Action cited in Application No. 102008057555.0-34, dated Aug. 14, 2009, 4 pages.

* cited by examiner

*Primary Examiner* — Mohamad Musleh
(74) *Attorney, Agent, or Firm* — Barley Snyder

(57) ABSTRACT

The relay has a movable first contact, a second contact, and an actuating element operatively connected with an armature of the relay. The first contact is movable toward the second contact by the actuating element and dependent on a supply of current to the relay. A snap action spring connects the second contact to a housing of the relay. The second contact is positioned between two arrangements by the snap action spring.

36 Claims, 9 Drawing Sheets

RELAY WITH SNAP ACTION SPRING

CROSS-REFERENCE TO RELATED APPLICATIONS

This application claims the benefit of the filing date under 35 U.S.C. §119(a)-(d) of German patent application DE 10 2008 057 555.0 of Nov. 15, 2008.

FIELD OF THE INVENTION

The invention relates to a relay with a movable contact, and more particularly relates to a snap action spring associated with the movable contact.

BACKGROUND

Relays with spring switch contacts are known from the prior art, for example from U.S. Pat. No. 6,943,653 B2 and from European patent application EP 1 300 866 A1.

SUMMARY

An object of the invention among others is to provide an improved relay. The relay has a movable first contact, a second contact, and an actuating element operatively connected with an armature of the relay. The first contact is movable toward the second contact by the actuating element and dependent on a supply of current to the relay. A snap action spring connects the second contact to a housing of the relay. The second contact is positioned between two arrangements by the snap action spring.

BRIEF DESCRIPTION OF THE DRAWINGS

The invention will be explained in greater detail below with reference to the figures of which.

DETAILED DESCRIPTION OF THE EMBODIMENT(S)

For an improved understanding of the invention, it will now be described in more detail with the aid of the embodiments shown in the following figures.

Figure 1:
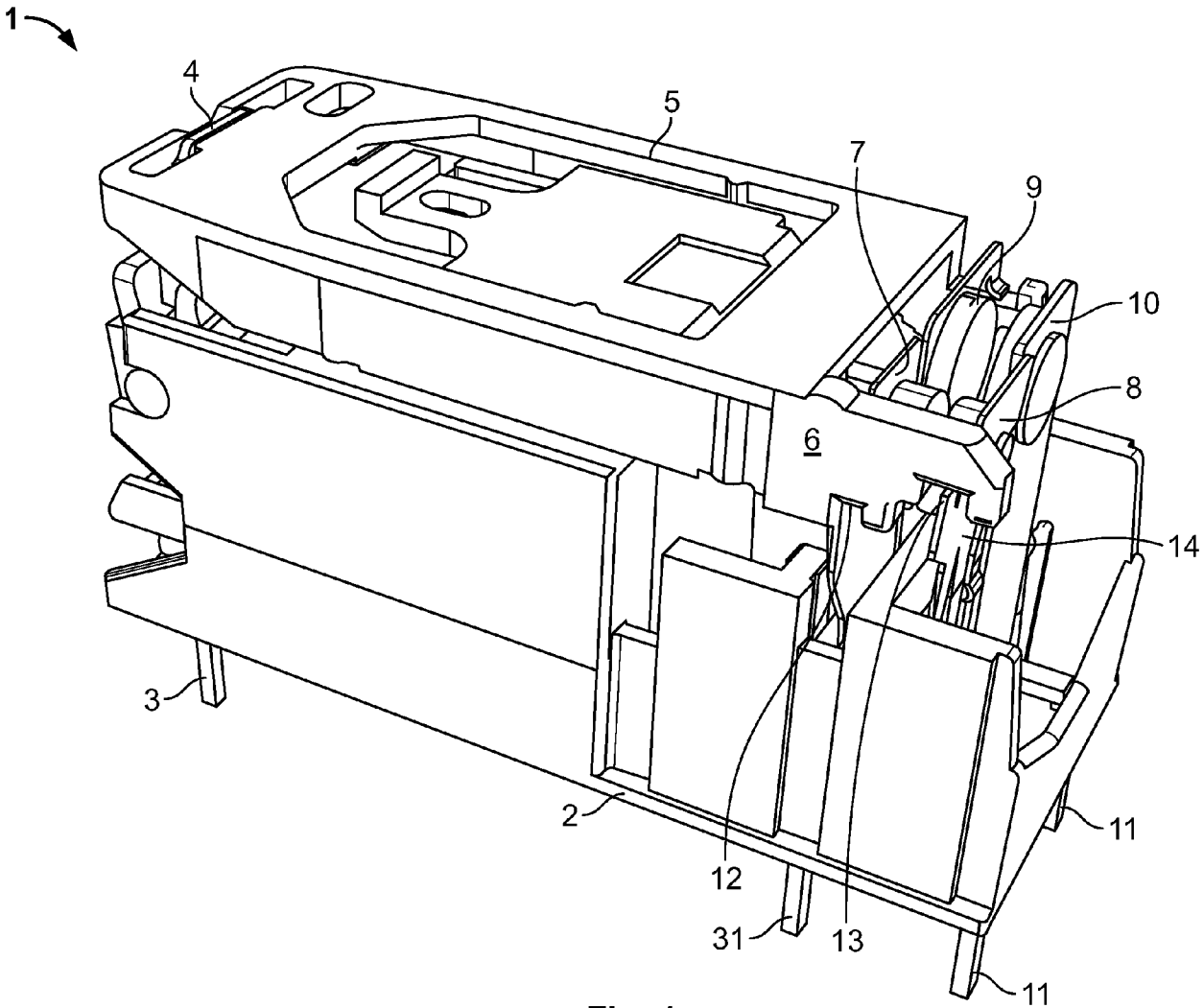
FIG. 1 is a perspective illustration of a relay having a contact with a snap action spring, according to the invention.

With reference to FIG. 1, a relay 1 is shown having a housing 2, in which a magnetic coil (not shown) with a yoke and an armature 4 is arranged. The magnetic coil (not shown) is supplied with current via connections 3. The armature 4 is in an operative connection with a slide frame 5 actuating element. The slide frame 5 is mounted on an upper side of the relay 1 to be displaceable along the longitudinal axis of the relay 1. The slide frame 5 has an actuating arm 6, which is in an operative connection with a movable first contact 7, as well as a movable second contact 8.

In the embodiment shown, a movable third contact 9 and a fourth contact 10 are additionally provided. The movable third contact 9 is connected to the moveable first contact 7, and moves upon movement of the movable first contact 7. The fourth contact 10 is a fixed contact, and is connected to the housing 2. The second contact 8 is connected to the housing 2 through a snap action spring 14.

The first contact 7, second contact 8, third contact 9 and fourth contact 10 each have first and third contact connections 11, 31 which extend from the underside of the housing 2. The third contact connections 31 are connected together, and further connect to the first and third contacts 7, 9. Likewise, the first contact connections 11 are connected together, and further connect to the second and fourth contacts 8, 10. The first and third contact connections 11, 31 are positioned and aligned in a line.

The actuating arm 6 is guided laterally past the movable first contact 7 and the second contact 8. The actuating arm 6 has a first cutout 12, into which the movable first contact 7 partially projects. In addition, the actuating arm 6 has a second cutout 13, into which the second contact 8 partially projects.

Figure 2:
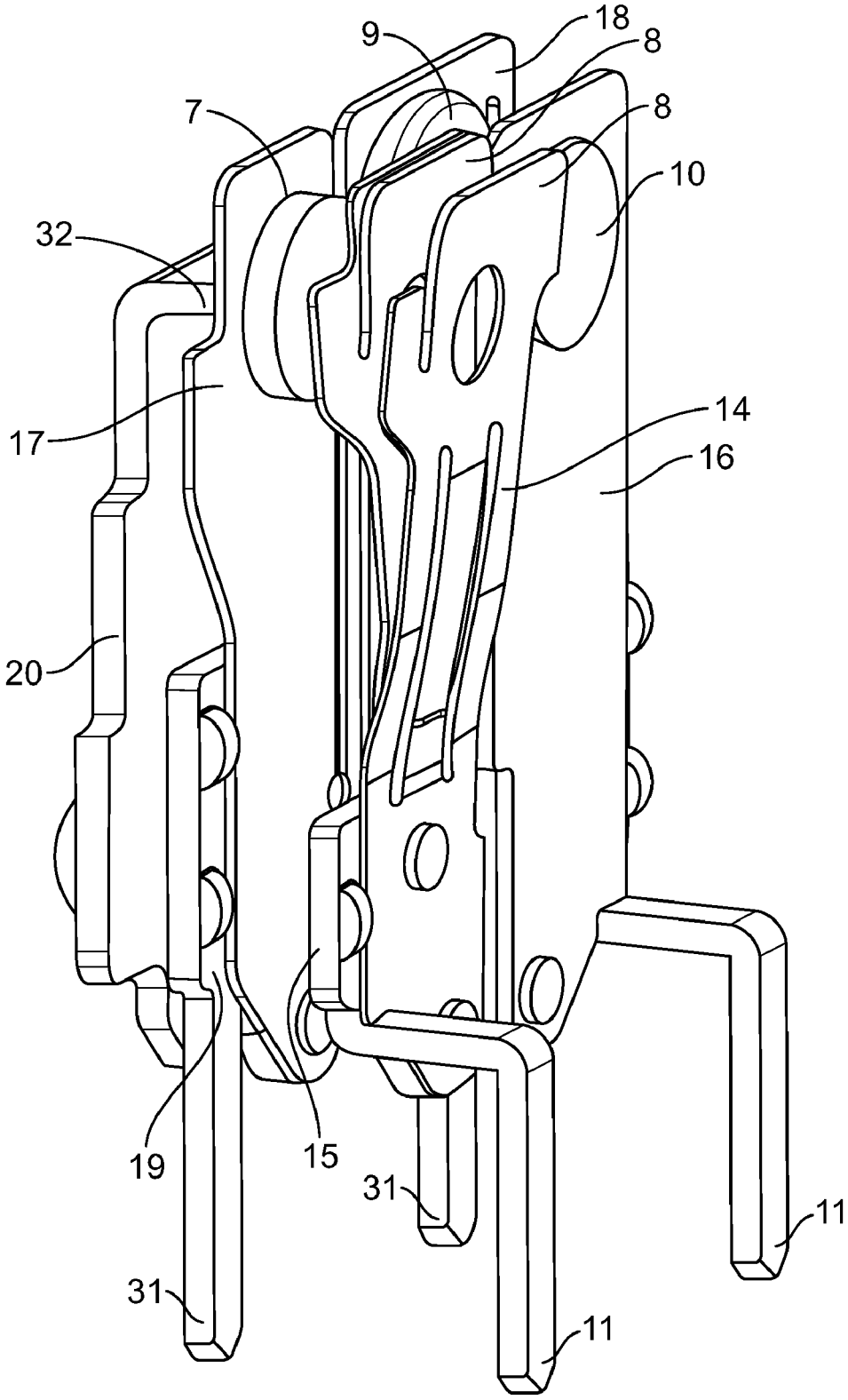
FIG. 2 is a perspective illustration of two pairs of contacts with the snap action spring, according to the invention.

FIG. 2 shows the contact arrangement of the shown embodiment, where the movable first and third contacts 7, 9 match with the second and fourth contacts 8, 10, respectively. In FIG. 2, two possible stable positions are being illustrated for the second contact 8. In one position, a contact piece is not being shown as an element on the second contact 8, for clarity. By way of the snap action spring 14, the second contact 8 can adjust to two stable positions. A first spring position is arranged closer to the movable first contact 7, than a second spring position.

The snap action spring 14 is fastened to a contact holder 15, which is made of an electrically conductive material and is connected to a contact connection 11. The fourth contact 10 is connected through a fixed electrically conductive plate 16 to the contact holder 15 and the corresponding contact connection 11. The contact holder 15 is fastened in the housing 2.

The movable first contact 7 and the movable third contact 9 are connected, through two plates 17, 18, to a third contact holder 19 which is fastened in the housing 2. The first contact 7 and the third contact 9 are separated in the upper end region, as illustrated in the embodiment shown. The third contact connections 31 protrude downwards out of the third contact holder 19. The first and the second plate 17, 18 are made to be resilient with regard to the third contact holder 19, and are made of an electrically conductive material. The first and the second plate 17, 18 are connected to the third contact connections 31. In addition, a stop element 20 is provided, which is connected to the third contact holder 19 and forms a stop 32 at the level of the contact pieces of the first and third contact 7, 9. The first and the third contact 7, 9 are pre-tensioned against the stop element 20 and are connected together.

Figure 3:
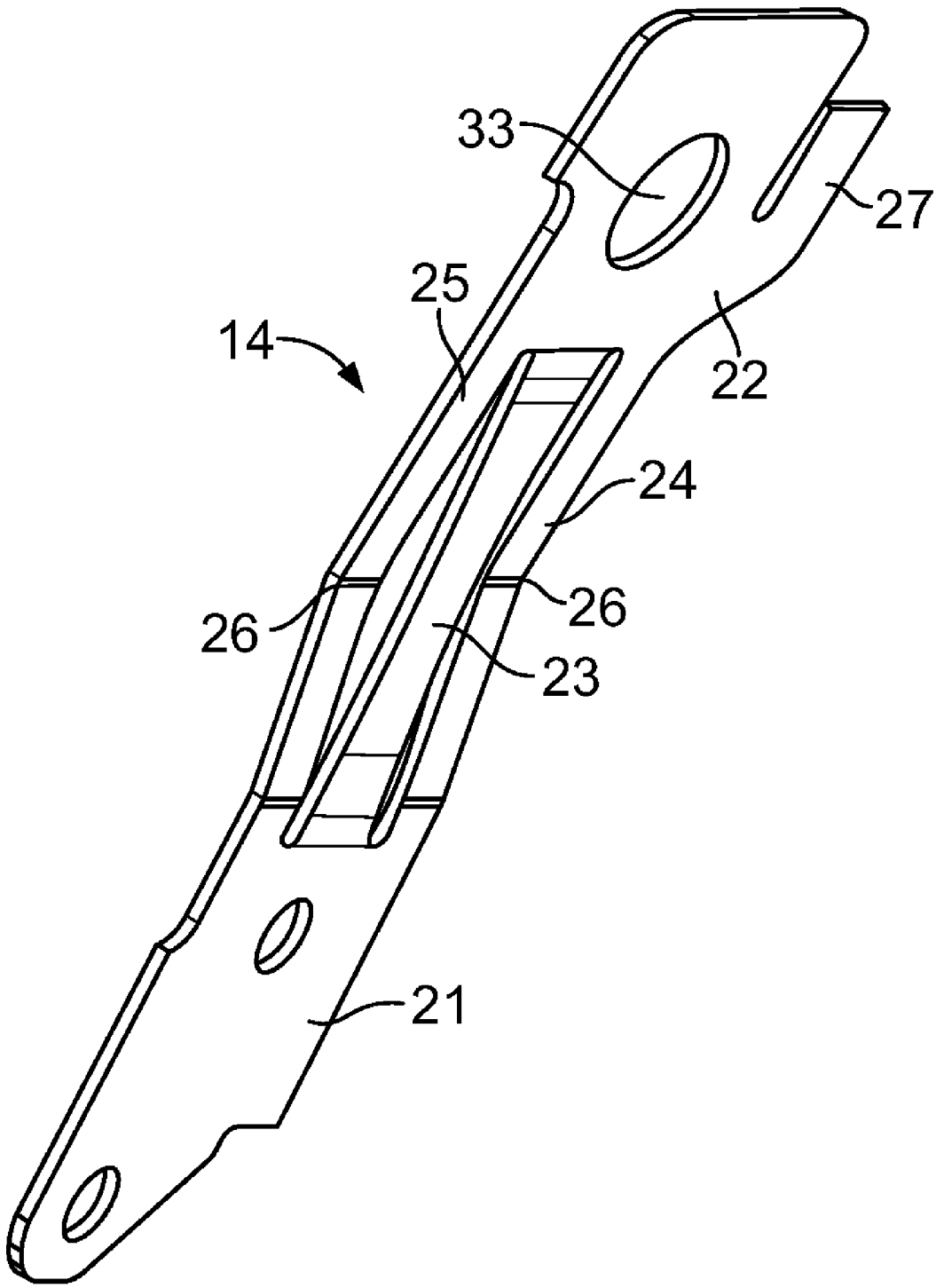
FIG. 3 is perspective illustration of the snap action spring, according to the invention.

FIG. 3 shows an enlarged view of the snap action spring 14, which has a first connection section 21. This first connection section 21 is connected to the contact holder 15. Starting from the first connection section 21, three webs pass upwards, which merge into a contact section 22. A middle web 23 is formed as a straight web. On either side of the middle web 23 there is provided a first outer web 24 and a second outer web 25. The two outer webs 24, 25 are angled, with angles formed in the same direction. Because of the angled shape of the first and second outer web 24, 25, the snap action spring 14 has two stable positions. The first stable position being when angled regions 26 are directed towards the plane of the drawing, and the second stable position being when the angled regions 26 are directed out of the plane of the drawing. The contact section 22 has a hole 33 for fastening a contact piece (not shown), such as a contact rivet.

In the contact section 22, a holding tab 27 is located on the snap action spring 14. The holding tab 27 is provided for engaging the second cutout 13 of the actuating arm 6.

According to the invention, the snap action spring 14 is, for example, made from an electrically conductive material such as steel. The design, of the embodiment shown, provides simple manufacturing and offers the desired function in only one component. This achieves a closed system without an increase in tolerance due to several components.

Figure 4:
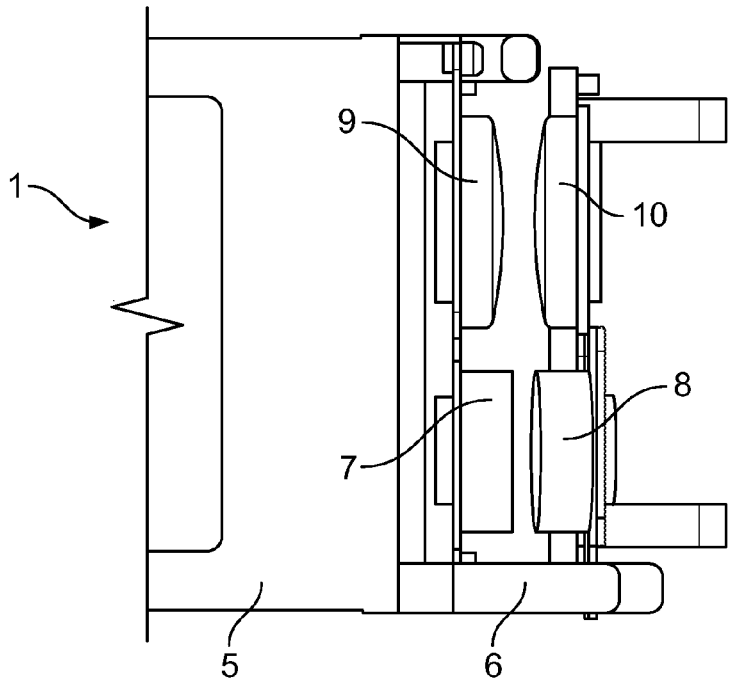
FIG. 4 is a top view of a pair of switching contacts of a relay in an open position.

With reference to FIG. 4, the relay 1 is shown having a contact arrangement where the electrical contacts 7, 8, and 9 are in a starting position.

In the starting position, the armature 4 is, for example, not supplied with a current, and thus the slide frame 5 is in a starting position. In the starting position, the first pair of contacts, consisting of the movable first contact 7 and second contact 8, are normally open. In addition, the second pair of contacts, consisting of the movable third contact 9 and the stationary fourth contact 10, are also normally open. However, the distance between the movable first contact 7 and the second contact 8 is less than the distance between the movable third contact 9 and the fixed fourth contact 10.

Figure 5:
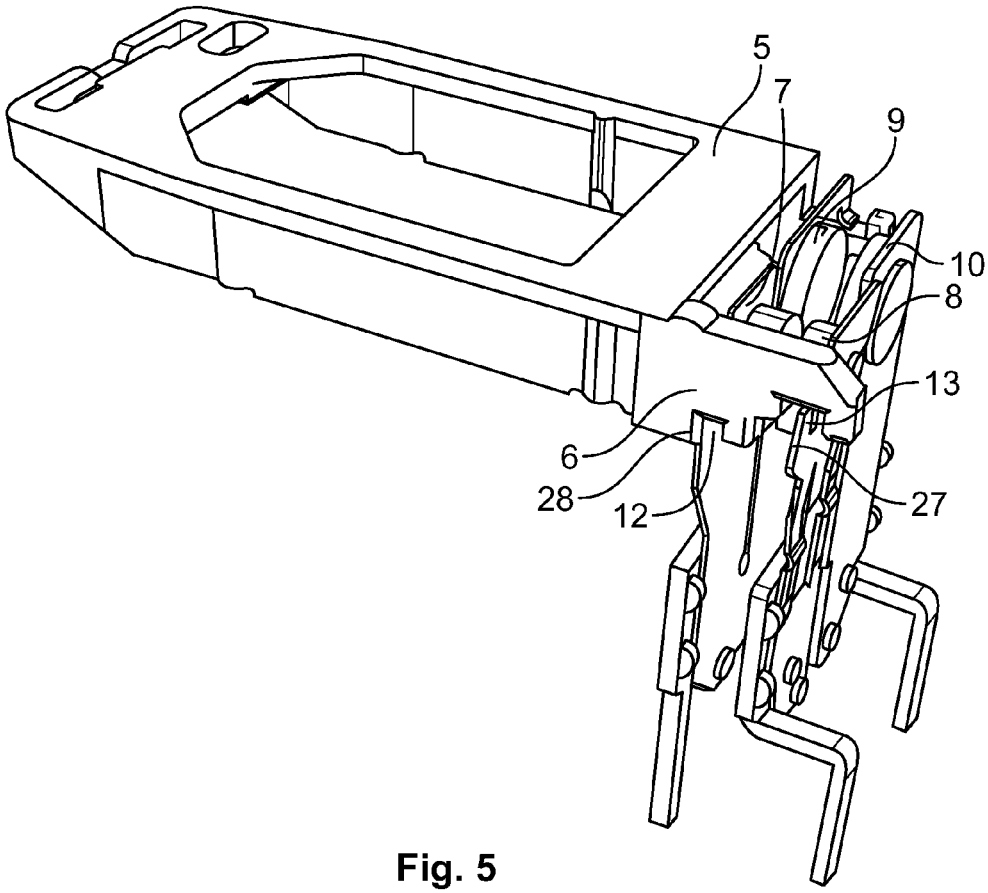
FIG. 5 is a side view of the pair of switching contacts of the relay with the switching contacts in an open position.

With reference to FIG. 5, the movable first contact 7 can be seen lying against a lateral edge 28 of the first cutout 12. The holding tab 27 of the snap action spring 14, on the other hand, is arranged in the center of the second cutout 13.

Figure 6:
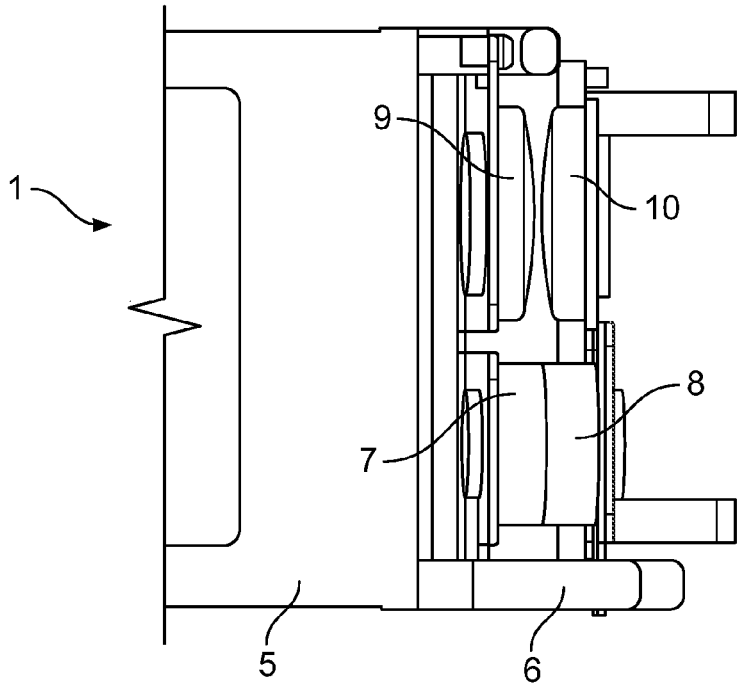
FIG. 6 is a top view of the pair of switching contacts of the relay with a first pair of contacts being contacted.

When the armature 4 is energized, the slide frame 5 moves toward the contact arrangement, with the movable first contact 7 and the movable third contact 9 being moved towards the second and fourth contacts 8, 10, respectively. The slide frame 5 moves the movable first contact 7 and the movable third contact 9 by the first cutout 12, until the movable first contact 7 and second contact 8 close, as illustrated in FIG. 6. In this position, the movable third contact 9 and the fourth contact 10 are still open. Thus a starting current for a load, for example a lighting element, is switched by the first contact 7 and the second contact 8.

Figure 7:
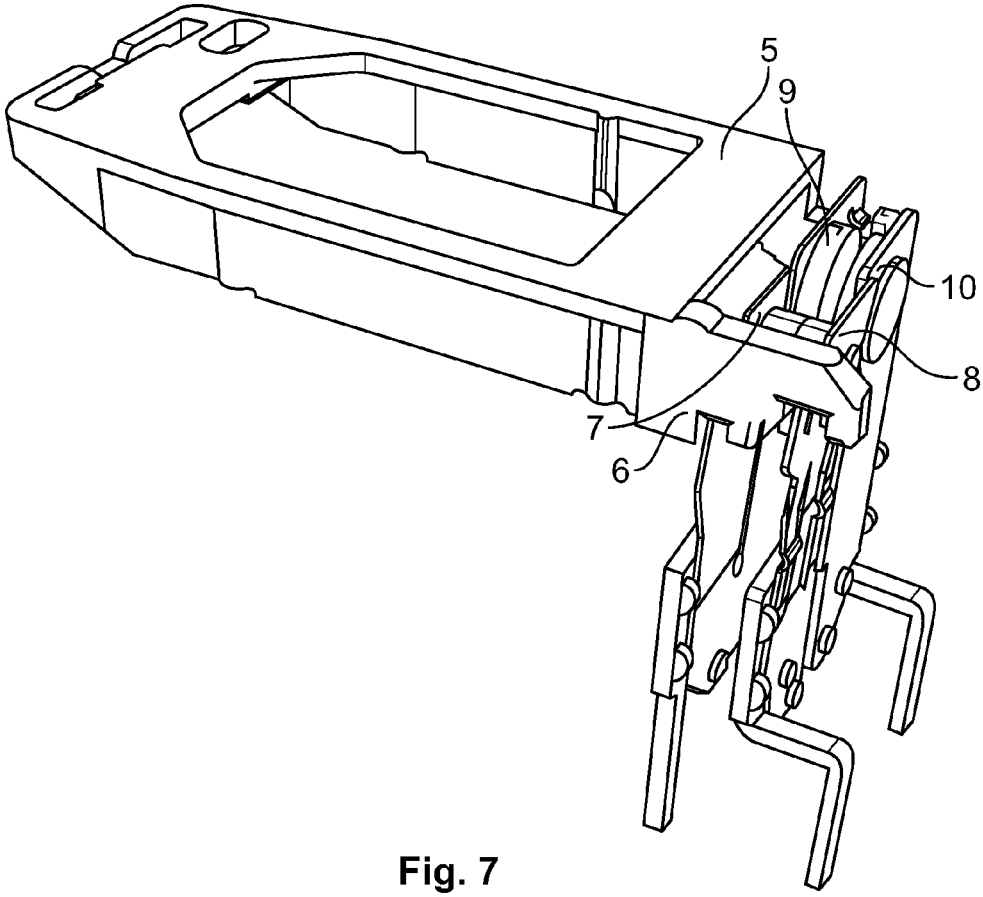
FIG. 7 is a side view of the pair of switching contacts of the relay with the first pair of contacts being contacted.

As shown in FIG. 7, the holding tab 27 is shown still freely arranged in the second cutout 13. Accordingly, the movement of the slide frame 5 from the position of FIG. 4 up to the position of FIG. 6 represents a first movement.

Figure 8:
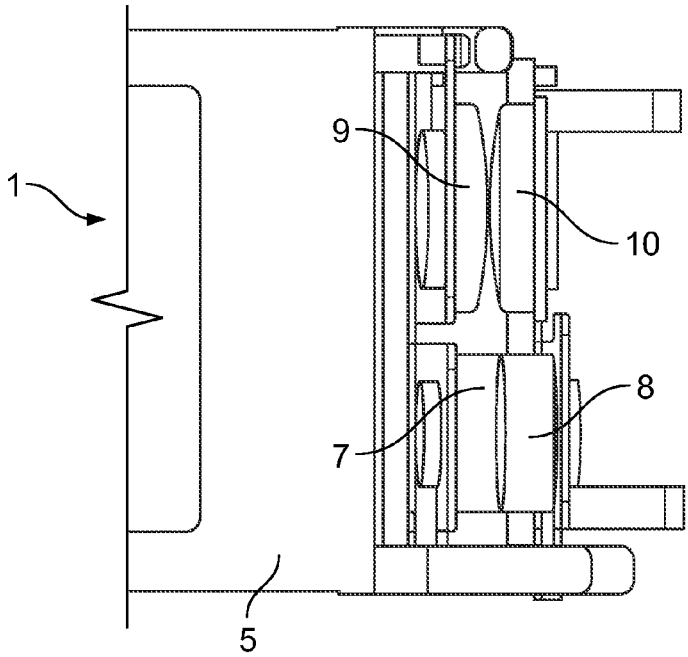
FIG. 8 is a top view of the pair of switching contacts of the relay with both pairs of contacts being contacted.

In a second movement, the slide frame 5 is moved further towards the contact arrangement until the movable third contact 9 and fourth contact 10 close. As shown in FIG. 8, both pairs of contacts are closed. In this switching position, the movable first contact 7 and the second contact 8 are also still closed.

Figure 9:
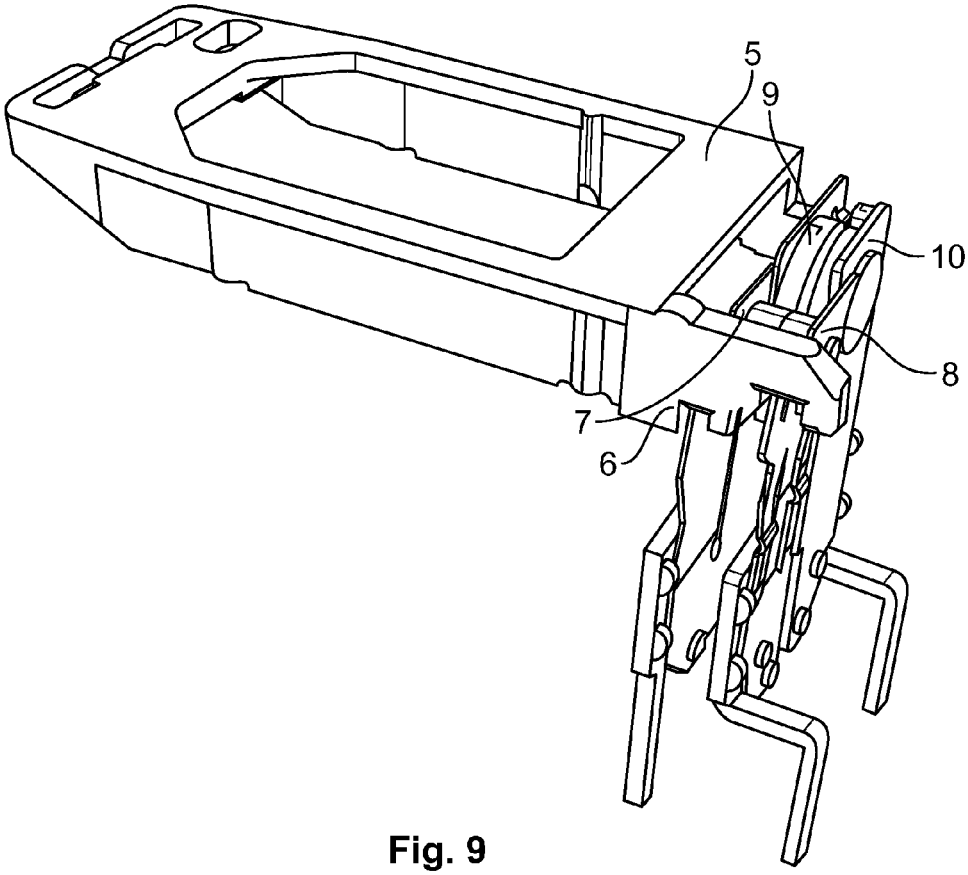
FIG. 9 is a side view of the pair of switching contacts of the relay with both pairs of contacts being contacted.

In the switching position of FIG. 8, both pairs of contacts are closed, the snap action spring 14 is in an unstable position, wherein the angled regions 26 of the outer webs 24, 25 are pointed away from a plane formed by the first and third contacts 6, 9. As shown in FIG. 9, the snap action spring 14 is tending to toggle into the second stable position, where the angled regions 26 of the outer webs 24, 25 are pointed toward the plane formed by the first and third contacts 6, 9. Because of mass inertia and the initial tension of the snap action spring 14, the toggling takes place only after a holding time, after which the slide frame 5 has reached its end position, where both pairs of contacts are closed.

Figure 10:
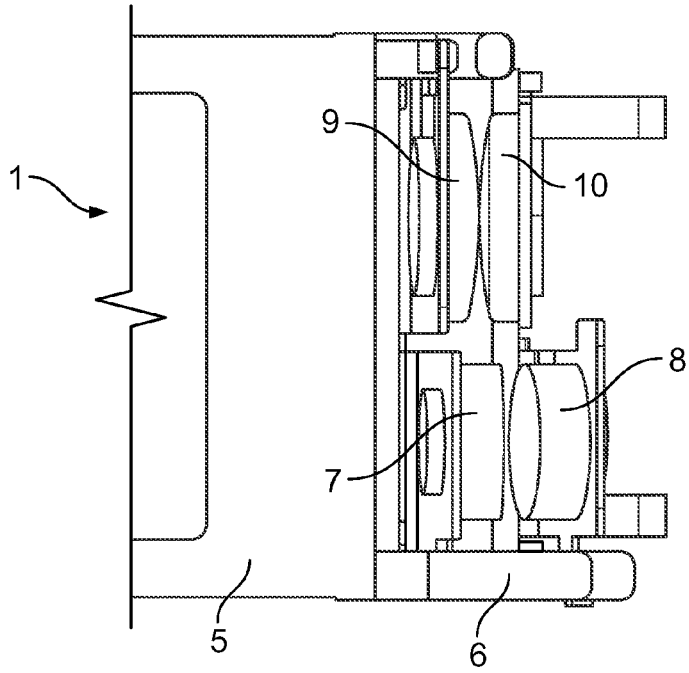
FIG. 10 is a top view of the pair of switching contacts of the relay once the snap action spring has toggled.

After the snap action spring 14 toggles into the second stable position, which is spaced apart from the movable first contact 7, electrical contact between the movable first contact 7 and the second contact 8 are opened, as shown in FIG. 10. Thus the opening of the first pair of contacts 7, 8 takes place, staggered in time from the reaching of the end position of the slide frame 5, and independently of any further movement of the slide frame 5. The time-delayed switching occurs as a function of the snap action spring 14. The holding time, after which the snap action spring 14 toggles, can be determined by configuring the form and material of the snap action spring 14.

Figure 11:
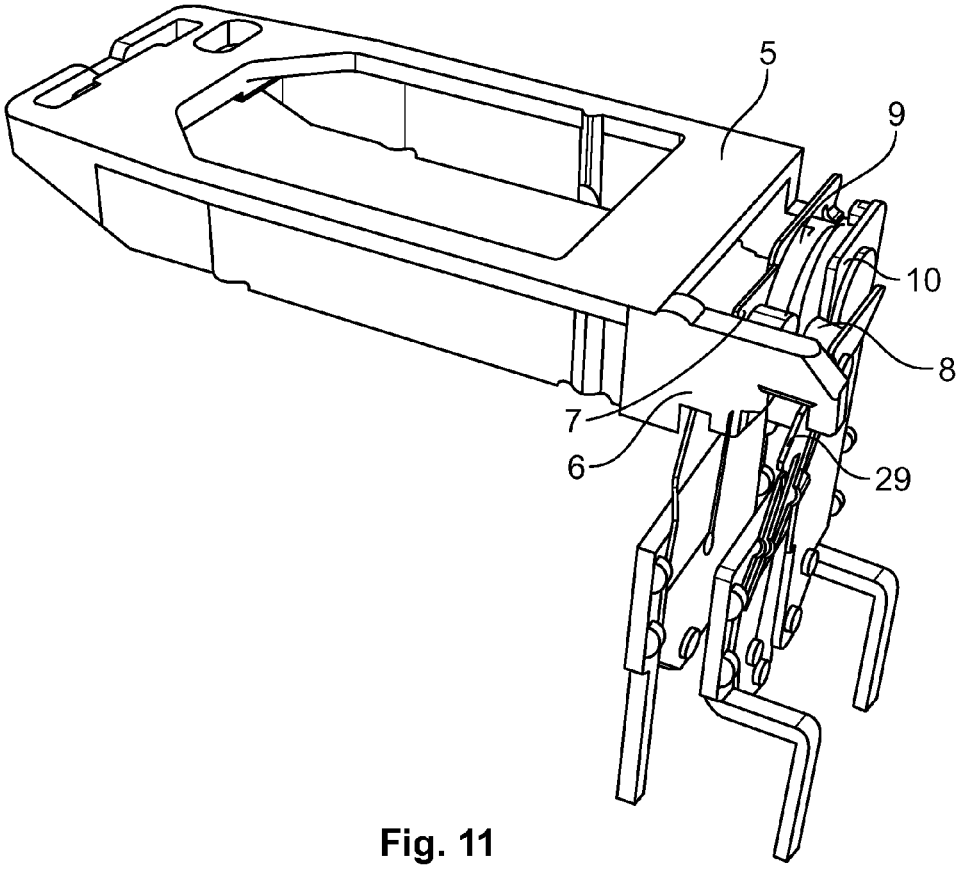
FIG. 11 is a side view of the pair of switching contact of the relay once the snap action spring has toggled.
Figure 12:
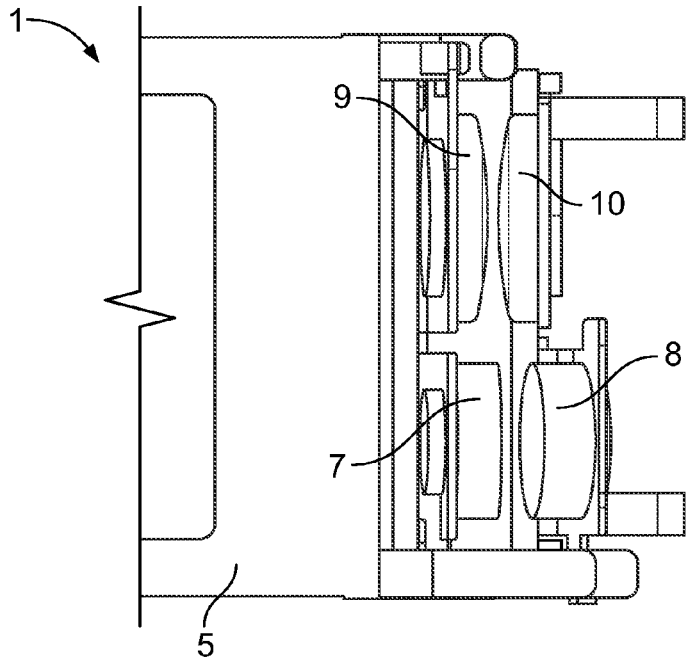
FIG. 12 is a top view of the pair of switching contacts of the relay shortly after the second pair of contacts have opened.
Figure 13:
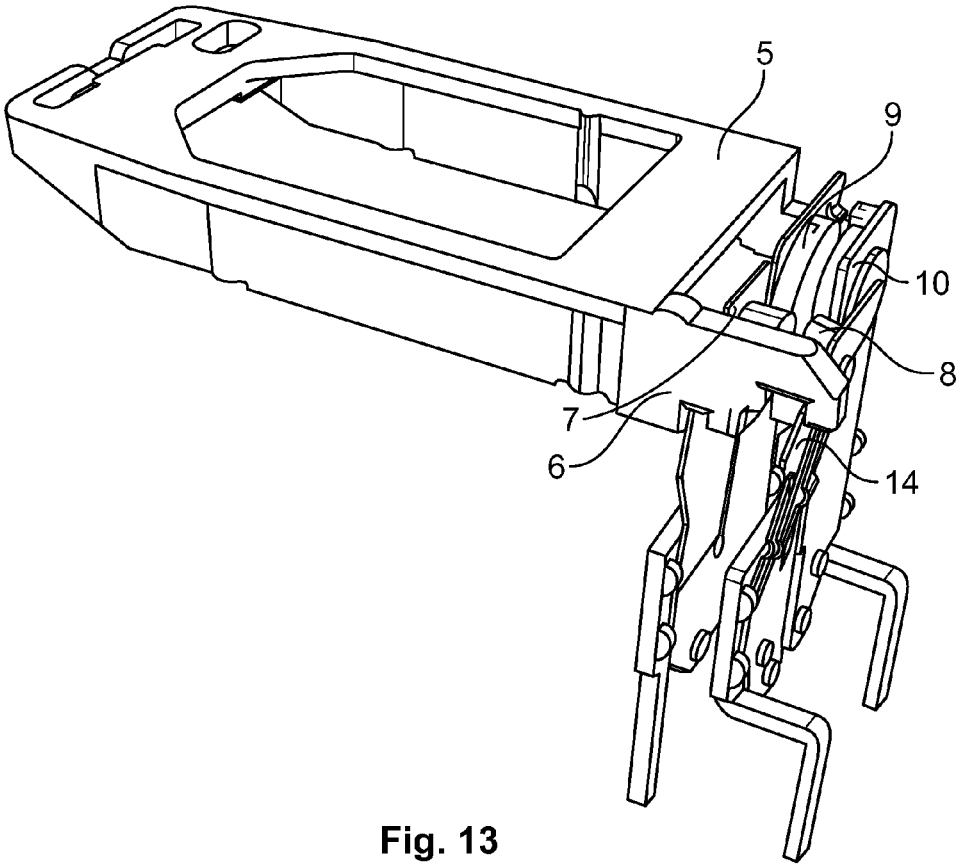
FIG. 13 is a side view of the pair of switching contacts of the relay shortly after the second pair of contacts has opened.

FIG. 11 depicts a side view of the switching position of FIG. 10, it being clearly seen that the snap action spring 14 has toggled into the second position, and in doing so, the snap action spring 14 lies against a second lateral edge 29 of the second cutout 13. The slide frame 5 is in the end position. As can be seen from FIG. 10, the first pair of contacts, i.e. the movable first contact 7 and the second contact 8, are now opened, the second pair of contacts still being closed. If the slide frame 5 is now moved, from the end position, back into the starting position (i.e. away from the contact arrangement), due to correspondingly supplying current to the armature 4, the movable first and third contacts 7, 9 are also moved towards the stop element 20, and back into the starting position. (see FIG. 12) Thus the second pair of contacts, i.e. the movable third contact 9 and the fourth contact 10, open, therefore breaking current for the load which is to be switched. In this position, the snap action spring 14 is still in the second stable position and lies against the second lateral edge 29, as can be seen from FIG. 13. The transition from the switching position of FIG. 10 into the switching position of FIG. 12 is set by a third movement of the slide frame 5.

Figure 14:
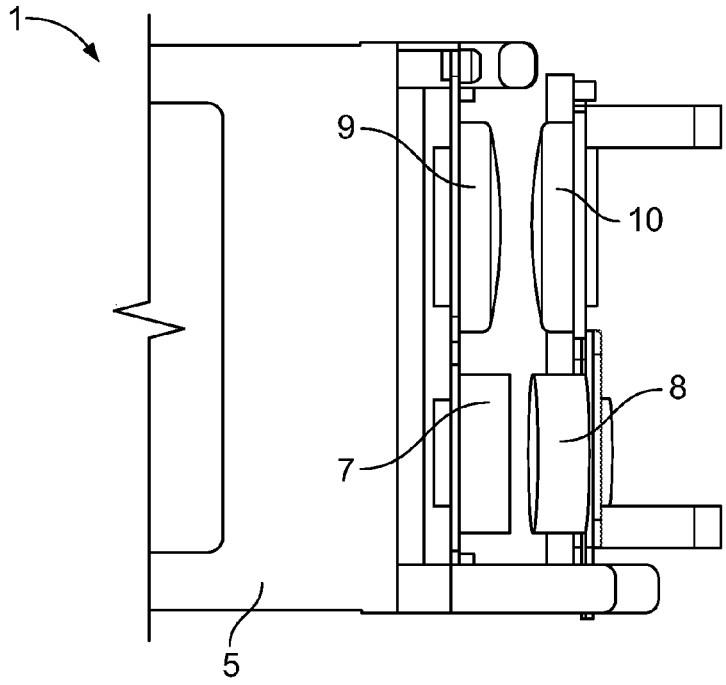
FIG. 14 is a top view of the pair of the switching contacts back in a starting position.

If the slide frame 5, in a fourth movement, is now pushed completely back into the starting position, the first and third contacts 7, 9 move back into the starting position. In addition, the snap action spring 14 is brought back into an unstable position, in which the snap action spring 14 toggles back into the starting position, as shown in FIG. 14.

Figure 15:
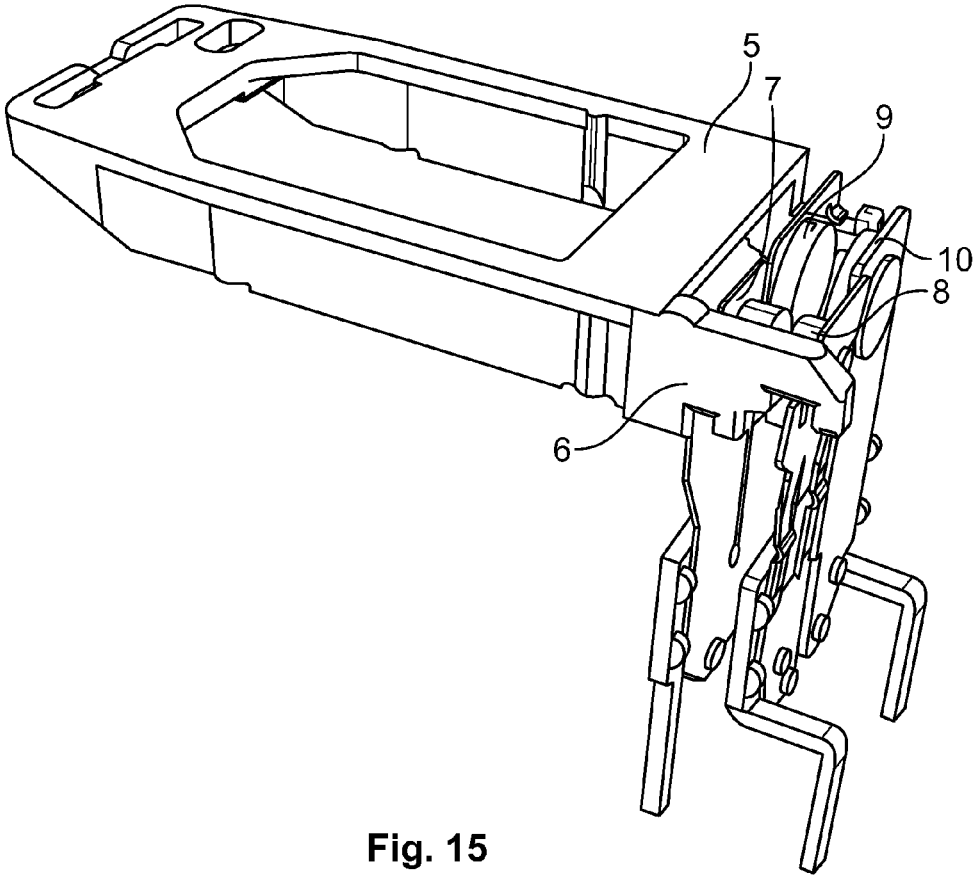
FIG. 15 is a side view of the pair of the switching contacts back in a starting position.

With reference to FIG. 15, the first and third contacts 7, 9 and the second and fourth contacts 8, 10 have contact pieces such as contact rivets. As such, the materials of the contact rivets of the two pairs of contacts are formed differently. Thus, for example, the movable first contact 7 and the second contact 8 have contact rivets of AgSnO, whereas, for example, the second pair of contacts, i.e. the movable third contact 9 and the fixed fourth contact 10, have contact rivets made of tungsten.

Depending on the selected embodiment, the slide frame 5 and the contacts 7, 8, 9, 10 can be in the starting position when current is supplied to the armature 4 and transfer into the end position when the current supply is switched off.

In addition, in another embodiment, only the movable first contact 7 and the second contact 8 may be provided as contacts.

Furthermore, also in another embodiment, the fourth contact 10 may have a snap action spring 14, and be formed preferably identically to the second contact 8.

In this manner, a relay having a pair of movable contacts with the known snap-action spring 14 can be constructed, where different demands on the set of contacts, and in particular on the contact materials, is possible. Therefore, it is possible, for example, to switch a starting current through a first set of contacts, while a sustained current can then, for example, be switched through the second set of contacts.

While the embodiments of the present invention have been illustrated in detail, it should be apparent that modifications and adaptations to those embodiments may occur. The scope of the invention is therefore limited only by the following claims.

What is claimed:

1. A relay comprising:

a movable first contact;

a second contact;

an actuating element operatively connected with an armature of the relay, the first contact movable toward the second contact by the actuating element and dependent on a supply of current to the relay; and a snap action spring having a flat middle web and an angled outer web and connecting the second contact to a housing of the relay, the second contact positioned between two stable positions by the snap action spring when an angled region of the angled outer web is directed away or toward the flat middle web.

2. The relay according to claim 1, further comprising a third contact movable toward a fourth contact by the actuating element.

3. The relay according to claim 2, wherein the fourth contact is a fixed contact.

4. The relay according to claim 3, wherein the actuating element is a slide.

5. The relay according to claim 4, further comprising a first cutout formed in the actuating element to engage the first contact.

6. The relay according to claim 4, further comprising a second cutout formed in the actuating element to engage the second contact.

7. The relay according to claim 5, wherein the first and third contacts move toward the second and fourth contacts by the actuating element, wherein a distance between the first contact and the second contact is less than a distance between the third contact and the fourth contact such that first contact and the second contact close sooner than the third contact and the fourth contact close.

8. The relay according to claim 7, wherein the actuating element moves the second contact into an unstable position.

9. The relay according to claim 8, wherein the actuating element is configured to move the first contact and the second contact back into a starting position.

10. The relay according to claim 8, wherein the second and the fourth contacts are formed of different materials.

11. The relay according to claim 2, wherein the first and third contacts move toward the second and fourth contacts by the actuating element, wherein a distance between the first contact and the second contact is less than a distance between the third contact and the fourth contact such that first contact and the second contact are closed sooner than when the third contact and the fourth contact are closed.

12. The relay according to claim 11, wherein the actuating element moves the second contact into an unstable position.

13. The relay according to claim 12, wherein the actuating element is configured to move the first contact and the second contact back into a starting position.

14. The relay according to claim 12, wherein the second and the fourth contacts are formed of different materials.

15. The relay according to claim 2, wherein the second and the fourth contacts are formed of different materials.

16. The relay according to claim 1, wherein the actuating element is a slide.

17. The relay according to claim 1, further comprising a first cutout formed in the actuating element to engage the movable first contact.

18. The relay according to claim 1, further comprising a second cutout formed in the actuating element to engage the second contact.

19. The relay according to claim 1, wherein the actuating element moves the first contact towards the second contact in a first movement.

20. The relay according to claim 19, wherein the actuating element moves the second contact into an unstable position by a second movement.

21. The relay according to claim 20, wherein the second contact in the unstable position toggles into a second position after a holding time, wherein the second contact is spaced apart from the movable first contact.

22. The relay according to claim 1, wherein the actuating element is configured to move the first contact and the second contact back into a starting position.

23. The relay according to claim 1, wherein the snap action spring includes a first connection section connected to the housing.

24. The relay according to claim 23, wherein the first connection section connects to the flat middle web and the angled outer web.

25. The relay according to claim 24, wherein the flat middle web and the angled outer web merge into a contact section securing the second contact.

26. A relay comprising:

a movable first contact;

a second contact;

an actuating element operatively connected with an armature of the relay, the first contact movable toward the second contact by the actuating element and dependent on a supply of current to the relay;

a third contact movable toward a fourth contact by the actuating element; and a snap action spring connecting the second contact to a housing of the relay, the second contact positioned between two positions by the snap action spring;

wherein the first and third contacts move toward the second and fourth contacts by the actuating element, wherein a distance between the first contact and the second contact is less than a distance between the third contact and the fourth contact such that first contact and the second contact are closed before the third contact and the fourth contact are closed.

27. The relay according to claim 26, wherein the fourth contact is a fixed contact and the actuating element is a slide.

28. The relay according to claim 27, further comprising a first cutout formed in the actuating element to engage the first contact.

29. The relay according to claim 26, wherein first and third contacts move toward the second and fourth contacts by the actuating element, wherein a distance between the first contact and the second contact is less than a distance between the third contact and the fourth contact such that first contact and the second contact close before the third contact and the fourth contact close.

30. The relay according to claim 29, wherein the actuating element moves the second contact into an unstable position.

31. The relay according to claim 29, wherein the second and the fourth contacts are formed of different materials.

32. The relay according to claim 30, wherein the actuating element is configured to move the first contact and the second contact back into a starting position.

33. The relay according to claim 26, wherein the actuating element moves the second contact into an unstable position.

34. The relay according to claim 33, wherein the actuating element is configured to move the first contact and the second contact back into a starting position.

35. The relay according to claim 33, wherein the second and the fourth contacts are formed of different materials.

36. A relay comprising:

a movable first contact;

a second contact;

a slide actuating element operatively connected with an armature of the relay, the first contact movable toward the second contact by the slide actuating element and dependent on a supply of current to the relay;

a third contact movable toward a fourth fixed contact by the slide actuating element; and a snap action spring connecting the second contact to a housing of the relay, the second contact positioned between two positions by the snap action spring; and a first cutout formed in the slide actuating element to engage the first contact;

wherein the first and third contacts move toward the second and fourth contacts by the slide actuating element, a distance between the first contact and the second contact being less than a distance between the third contact and the fourth contact such that the first contact contacts the second contact before the third contact contacts the fourth contact.

* * * * *